US010290914B2

(12) United States Patent
Liu et al.

(10) Patent No.: US 10,290,914 B2
(45) Date of Patent: May 14, 2019

(54) WAVEGUIDE APPARATUS COMPRISED OF FIRST AND SECOND WAVEGUIDE MEMBERS CONFIGURED TO BE ATTACHED TO EACH OTHER AT DIAGONALLY OPPOSITE CORNERS

(71) Applicant: MICROELECTRONICS TECHNOLOGY, INC., Hsinchu (TW)

(72) Inventors: Hui-Na Liu, Hsinchu (TW); Chang-Chun Chen, Hsinchu (TW); Wei Huang Chen, Zhubei (TW)

(73) Assignee: MICROELECTRONICS TECHNOLOGY, INC, Hsinchu (TW)

( * ) Notice: Subject to any disclaimer, the term of this patent is extended or adjusted under 35 U.S.C. 154(b) by 0 days.

(21) Appl. No.: 15/595,259

(22) Filed: May 15, 2017

(65) Prior Publication Data

US 2018/0331409 A1 Nov. 15, 2018

(51) Int. Cl.
*H01P 3/12* (2006.01)
*H01Q 13/06* (2006.01)
*H01Q 13/02* (2006.01)

(52) U.S. Cl.
CPC ..... *H01P 3/12* (2013.01); *H01Q 13/02* (2013.01); *H01Q 13/06* (2013.01)

(58) Field of Classification Search
CPC ..... H01P 3/12
USPC ..... 333/239
See application file for complete search history.

(56) References Cited

U.S. PATENT DOCUMENTS 3,195,079 A * 7/1965 Burton et al. ..... H01P 11/002 138/143
4,439,748 A * 3/1984 Dragone ..... H01P 3/123 29/600
8,995,838 B1 3/2015 Schaffner et al.

FOREIGN PATENT DOCUMENTS

JP S5572301 U 5/1980
JP S60160204 A 8/1985
JP 2004015472 A 1/2004

* cited by examiner

*Primary Examiner* — Benny T Lee
(74) *Attorney, Agent, or Firm* — Muncy, Geissler, Olds & Lowe, P.C.

(57) ABSTRACT

The present disclosure provides a waveguide apparatus for receiving wireless signals. The waveguide apparatus includes a first waveguide member and a second waveguide member attached to the first waveguide member to form a waveguide having an aperture for receiving wireless signals. The first waveguide member includes a first wall and a second wall forming a first corner of the aperture, and the second waveguide member includes a third wall and a fourth wall forming a third corner of the aperture. After the first waveguide member is attached to the second waveguide member, the second wall and the third wall form a second corner of the aperture, and the fourth wall and the first wall form a fourth corner of the aperture.

7 Claims, 14 Drawing Sheets

| | 55GHz | | 57GHz | | 61.5GHz | | 66GHz | | 68GHz | |
|---|---|---|---|---|---|---|---|---|---|---|
| | E | H | E | H | E | H | E | H | E | H |
| Peak Gain (dBi) | 16.6 | 16.8 | 17.2 | 17.7 | 17.2 | 17.3 | 17.7 | 18.2 | 18.1 | 18.6 |
| Peak Gain Direction (deg) | 1.8 | 1 | -1.2 | -0.5 | 2.1 | 1.2 | 1.2 | 0.4 | -0.3 | 1.5 |
| Direction Difference between E-plane and H-plane (deg) | 0.8 | | 0.7 | | 0.9 | | 0.8 | | 1.8 | |

FIG. 10

| | 55GHz waveguide apparatus 60 | | 55GHz waveguide apparatus 10 | |
|---|---|---|---|---|
| | E | H | E | H |
| Peak Gain (dBi) | 16.6 | 15.5 | 16.6 | 16.8 |
| Peak Gain Direction (deg) | 3.7 | -0.5 | 1.8 | 1 |
| Direction Difference between E-plane and H-plane (deg) | 3.7 - (-0.5) = 4.2 | | 1.8 - 1 = 0.8 | |

FIG. 14

WAVEGUIDE APPARATUS COMPRISED OF FIRST AND SECOND WAVEGUIDE MEMBERS CONFIGURED TO BE ATTACHED TO EACH OTHER AT DIAGONALLY OPPOSITE CORNERS

TECHNICAL FIELD

The present disclosure relates to a waveguide apparatus for receiving wireless signals, and more particularly to a waveguide apparatus of two substantially identical waveguide members for receiving wireless signals.

DISCUSSION OF THE BACKGROUND

Wireless communication systems are widely employed to provide various communication content such as voice, video, packet data, messaging, broadcast, etc. These wireless systems may be multiple-access systems capable of supporting multiple users by sharing the available system resources. Examples of such multiple-access systems include code division multiple access (CDMA) systems, time division multiple access (TDMA) systems, frequency division multiple access (FDMA) systems, orthogonal FDMA (OFDMA) systems, and single-carrier FDMA (SC-FDMA) systems.

This Discussion of the Background section is provided for background information only. The statements in this Discussion of the Background are not an admission that the subject matter disclosed in this section constitutes prior art to the present disclosure, and no part of this Discussion of the Background section may be used as an admission that any part of this application, including this Discussion of the Background section, constitutes prior art to the present disclosure.

SUMMARY OF THE INVENTION

One aspect of the present disclosure provides a waveguide member, comprising a first wall and a second wall faulting a corner, wherein the waveguide member includes at least one first hole penetrating the first wall along a first direction and at least one second hole penetrating the second wall along the first direction.

Another aspect of the present disclosure provides a waveguide apparatus, comprising: a first waveguide member; a second waveguide member attached to the first waveguide member to form a waveguide having an aperture for receiving wireless signals; wherein the first waveguide member includes a first wall and a second wall forming a first corner of the aperture, the second waveguide member includes a third wall and a fourth wall forming a third corner of the aperture, the second wall and the third wall form a second corner of the aperture, and the fourth wall and the first wall form a fourth corner of the aperture.

In some embodiments, the second waveguide member is substantially the same as the first waveguide member.

In some embodiments, the first wall has a first outer surface, the second wall has a second outer surface, the first outer surface is planar, and the second outer surface is non-planar.

In some embodiments, the first waveguide member includes: at least one first hole penetrating the first wall along a first direction; and at least one second hole penetrating the second wall along the first direction.

In some embodiments, the second waveguide member includes: at least one third hole penetrating the third wall along the first direction; and at least one fourth hole penetrating the fourth wall along the first direction.

In some embodiments, the at least one first hole communicates with the at least one fourth hole, and the at least one second hole communicates with the at least one third hole.

In some embodiments, the fourth wall covers the at least one first hole, and the second wall covers the at least one third hole.

In some embodiments, the first waveguide member does not include a first opening penetrating the first wall along a second direction substantially perpendicular to the first direction.

In some embodiments, the first waveguide member does not include a second opening penetrating the second wall along the second direction.

In some embodiments, the second wall has a tapering upper end.

In some embodiments, the second wall has a wavy outer surface near an upper end.

In some embodiments, an upper end width of the first wall is substantially the same as an upper end width of the second wall.

In some embodiments, the inner planes of the first wall, the second wall, the third wall, and the fourth wall are not formed with a step structure.

In some embodiments, the second wall has a slanted side, the third wall has a slanted inner surface, and the second wall's slanted side is attached to the third wall's slanted inner surface.

The embodiments of the present disclosure provide a waveguide apparatus of two substantially identical waveguide members for receiving wireless signals. Consequently, the two waveguide members can be manufactured by substantially the same fabrication process. In addition, the waveguide apparatus is diagonally divided into two substantially identical waveguide members, and the two waveguide members can be assembled to form the waveguide apparatus substantially without a step structure in the inner plane of the waveguide.

The foregoing has outlined rather broadly the features and technical advantages of the present disclosure in order that the detailed description of the disclosure that follows may be better understood. Additional features and advantages of the disclosure will be described hereinafter, and form the subject of the claims of the disclosure. It should be appreciated by those skilled in the art that the conception and specific embodiment disclosed may be readily utilized as a basis for modifying or designing other structures or processes for carrying out the same purposes of the present disclosure. It should also be realized by those skilled in the art that such equivalent constructions do not depart from the spirit and scope of the disclosure as set forth in the appended claims.

BRIEF DESCRIPTION OF THE DRAWINGS

A more complete understanding of the present disclosure may be derived by referring to the detailed description and claims when considered in connection with the Figures, where like reference numbers refer to similar elements throughout the Figures, and:

FIG. 10 is a table showing the detailed electrical properties of the waveguide apparatus in accordance with some embodiments of the present disclosure.

FIG. 14 is a table showing the detailed electronic properties of the waveguide apparatus and the waveguide apparatus in accordance with the present disclosure.

DETAILED DESCRIPTION OF THE INVENTION

The following description of the disclosure accompanies drawings, which are incorporated in and constitute a part of this specification, and illustrate embodiments of the disclosure, but the disclosure is not limited to the embodiments. In addition, the following embodiments can be properly integrated to complete another embodiment.

References to "some embodiments," "an embodiment," "exemplary embodiment," "other embodiments," "another embodiment," etc. indicate that the embodiment(s) of the disclosure so described may include a particular feature, structure, or characteristic, but not every embodiment necessarily includes the particular feature, structure, or characteristic. Further, repeated use of the phrase "in the embodiment" does not necessarily refer to the same embodiment, although it may.

The present disclosure is directed to a waveguide apparatus of two substantially identical waveguide members for receiving wireless signals. In order to make the present disclosure completely comprehensible, detailed steps and structures are provided in the following description. Obviously, implementation of the present disclosure does not limit special details known by persons skilled in the art. In addition, known structures and steps are not described in detail, so as not to unnecessarily limit the present disclosure. Preferred embodiments of the present disclosure are described in detail below. However, in addition to the detailed description, the present disclosure may also be widely implemented in other embodiments. The scope of the present disclosure is not limited to the detailed description, but is defined by the claims.

Figure 1:
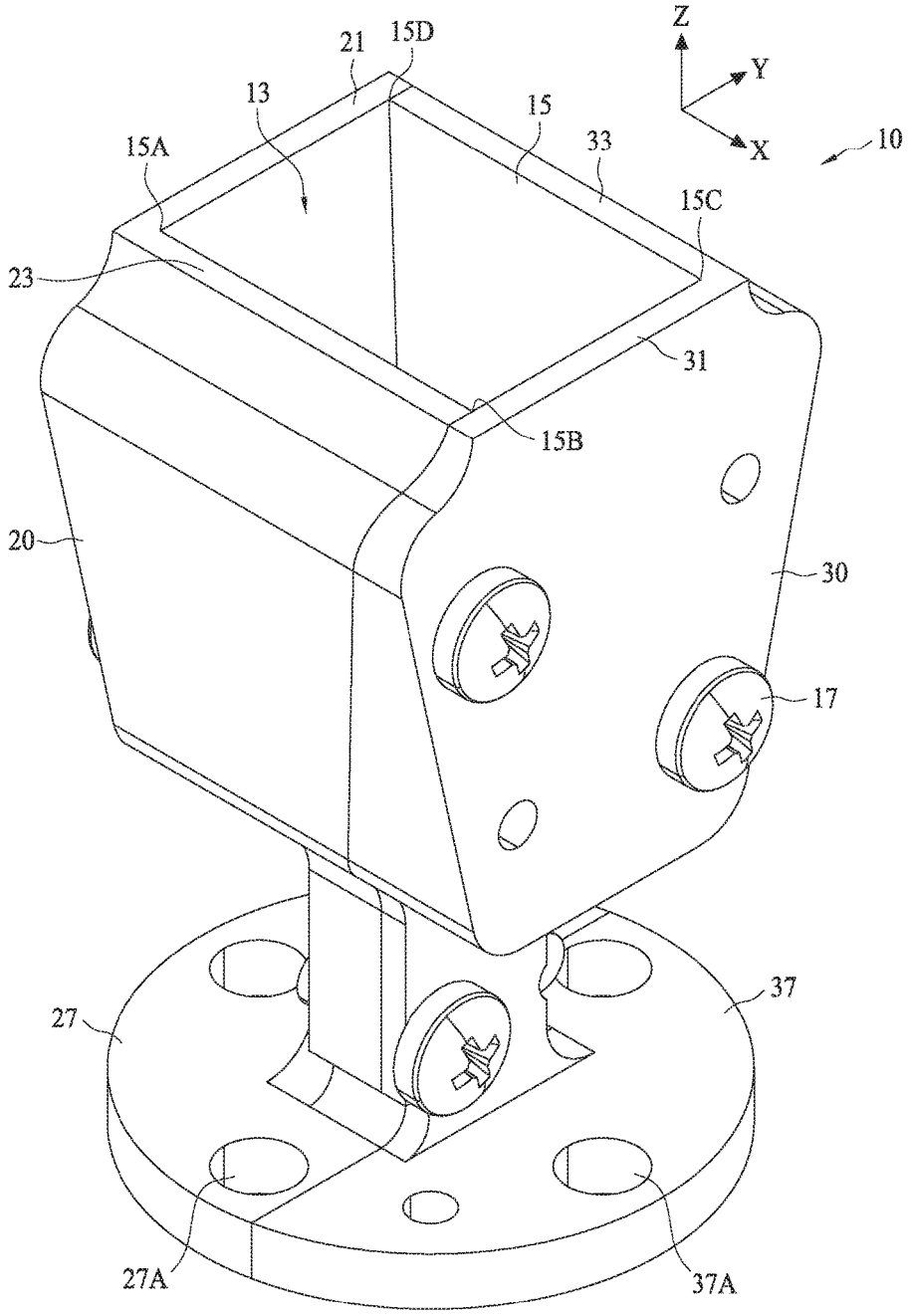
FIG. 1 is an assembled view of a waveguide apparatus in accordance with some embodiments of the present disclosure
Figure 2:
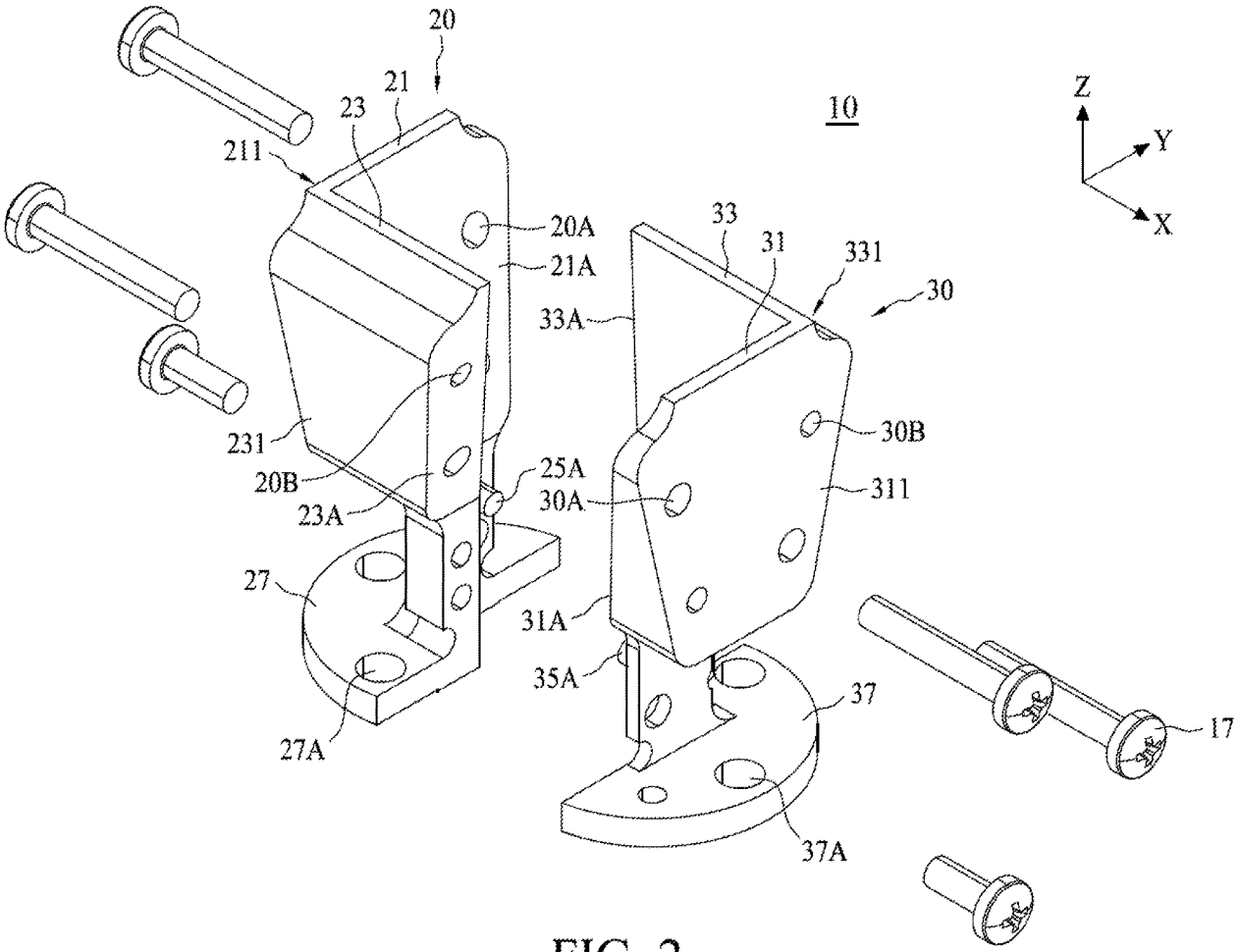
FIG. 2 is a disassembled view of the waveguide apparatus in accordance with some embodiments of the present disclosure.

FIG. 1 is an assembled view of a waveguide apparatus 10 in accordance with some embodiments of the present disclosure. FIG. 2 is a disassembled view of the waveguide apparatus 10 in accordance with some embodiments of the present disclosure. In some embodiments, the waveguide apparatus 10 comprises a first waveguide member 20 and a second waveguide member 30 attached to the first waveguide member 20 by several fasteners 17 to festal a waveguide 13 (FIG. 1) having an aperture 15 (FIG. 1) for receiving wireless signals.

In some embodiments, the waveguide apparatus 10 is diagonally divided into two substantially identical parts (the first waveguide member and the second waveguide member).

In some embodiments, the first waveguide member 20 includes a first wall 21 and a second wall 23 forming a first corner 15A (FIG. 1) of the aperture 15, the second waveguide member 30 includes a third wall 31 and a fourth wall 33 forming a third corner 15C (FIG. 1) of the aperture 15, the second wall and the third wall form a second corner 15B (FIG. 1) of the aperture 15, and the fourth wall 33 and the first wall 21 form a fourth corner 15D (FIG. 1) of the aperture 15. In some embodiments, the first wall 21 is substantially perpendicular to the second wall 23, and the third wall 31 is substantially perpendicular to the fourth wall 33; after assembling the first waveguide member 20 and the second waveguide member 30, the second wall 23 is substantially perpendicular to the third wall 31 and the first wall 21 is substantially perpendicular to the fourth wall 33.

In some embodiments, the aperture 15 of the waveguide 13 is rectangular with four corners, the first waveguide member 20 itself forms one of the four corners, the second waveguide member 30 itself forms another one of the four corners, and the combination of the first waveguide member 20 and the second waveguide member 30 forms the other two of the four corners.

Figure 3:
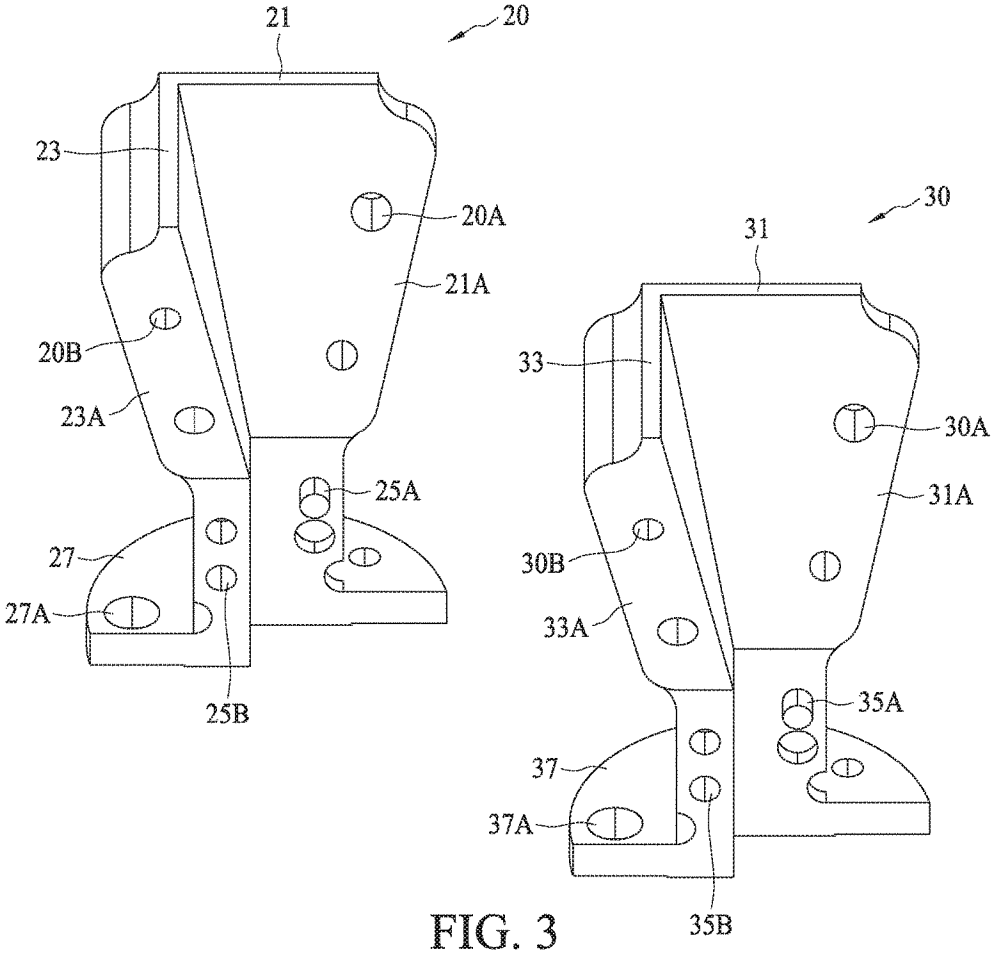
FIG. 3 is a disassembled view of the waveguide apparatus in accordance with some embodiments of the present disclosure.
Figure 4:
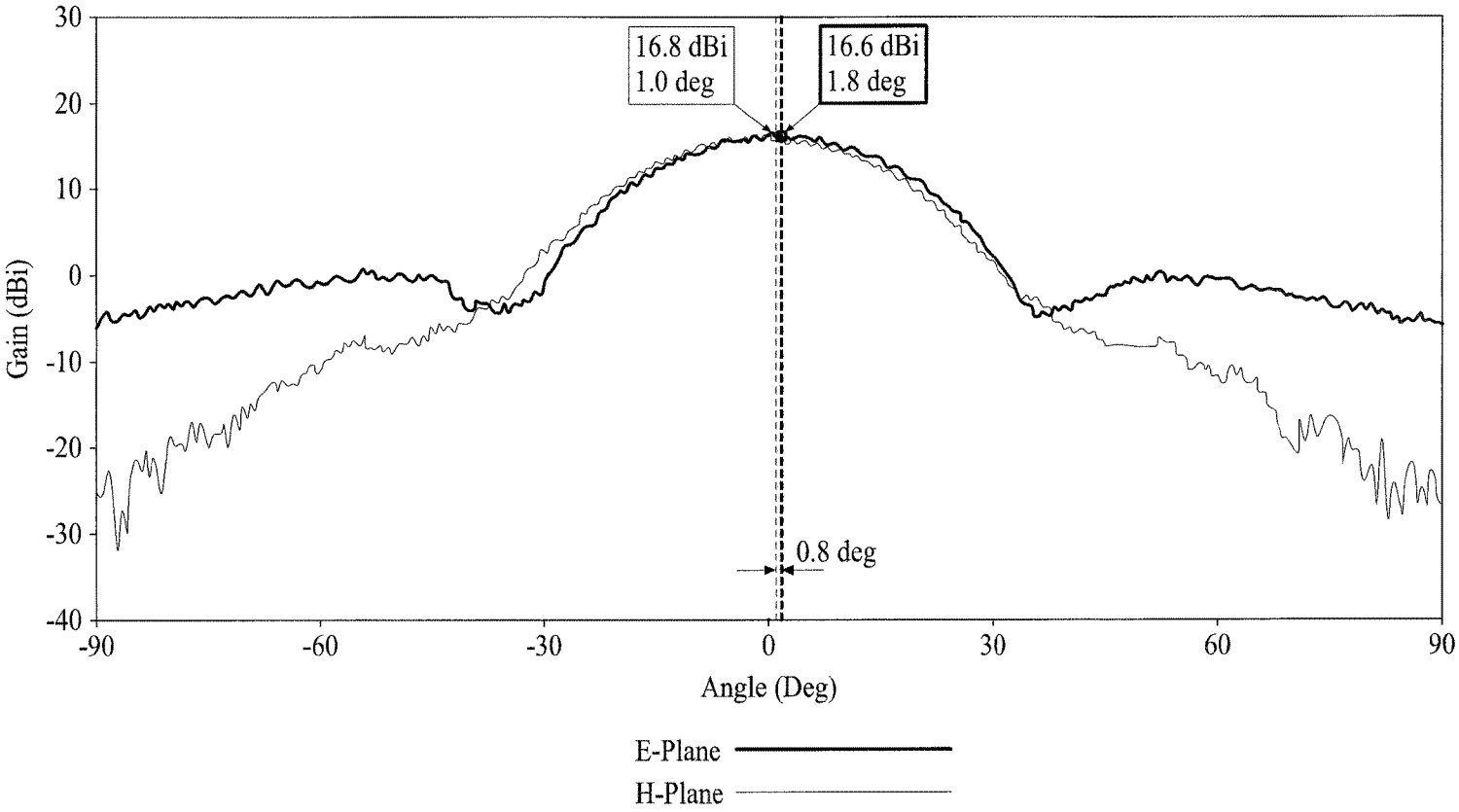
FIGS. 4 to 8 are gain (in dB) diagrams of the direction difference between the E-plane and the H-plane of the waveguide apparatus with respect to angles (in degrees or Deg) in accordance with some embodiments of the present disclosure.
Figure 5:
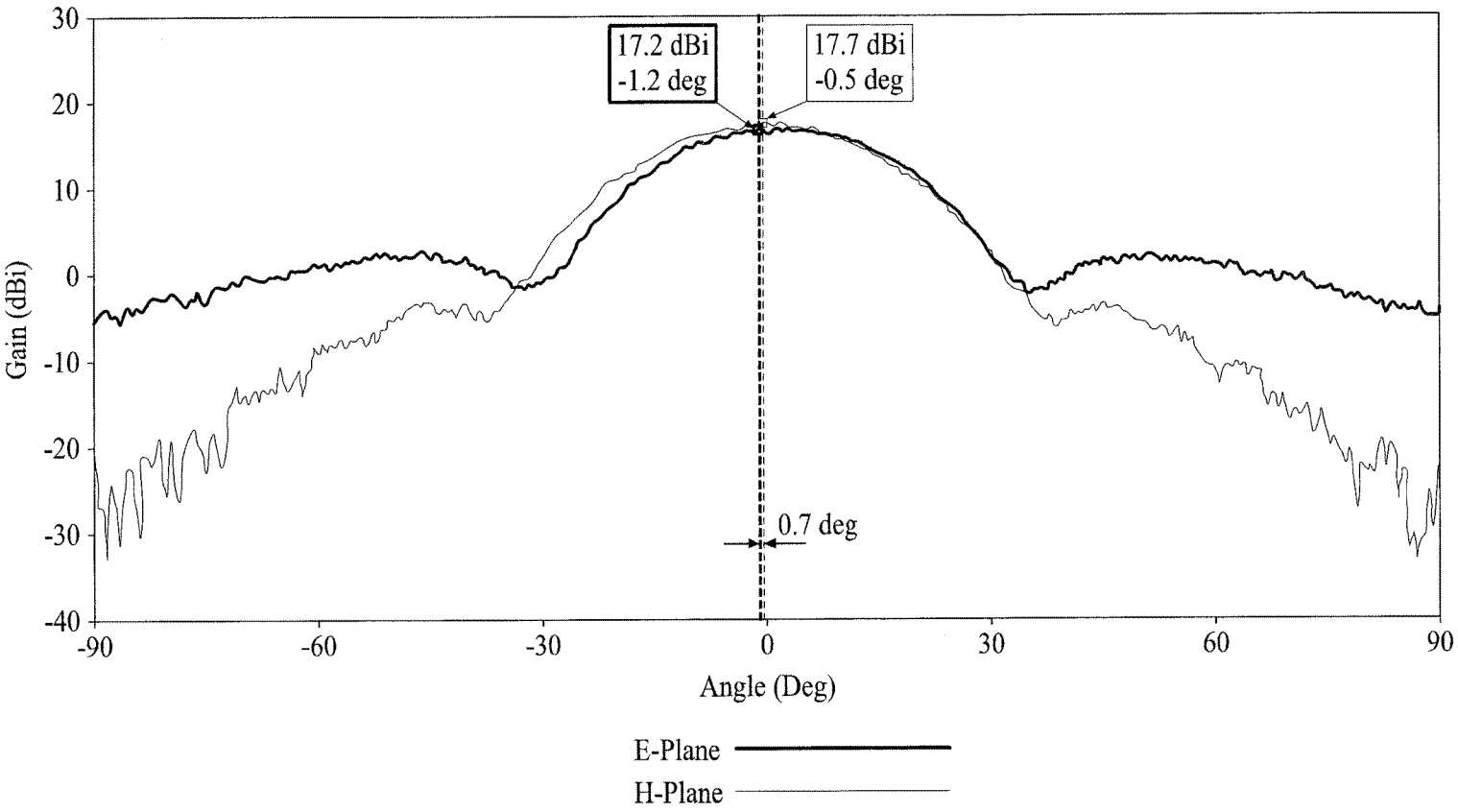
Figure 6:
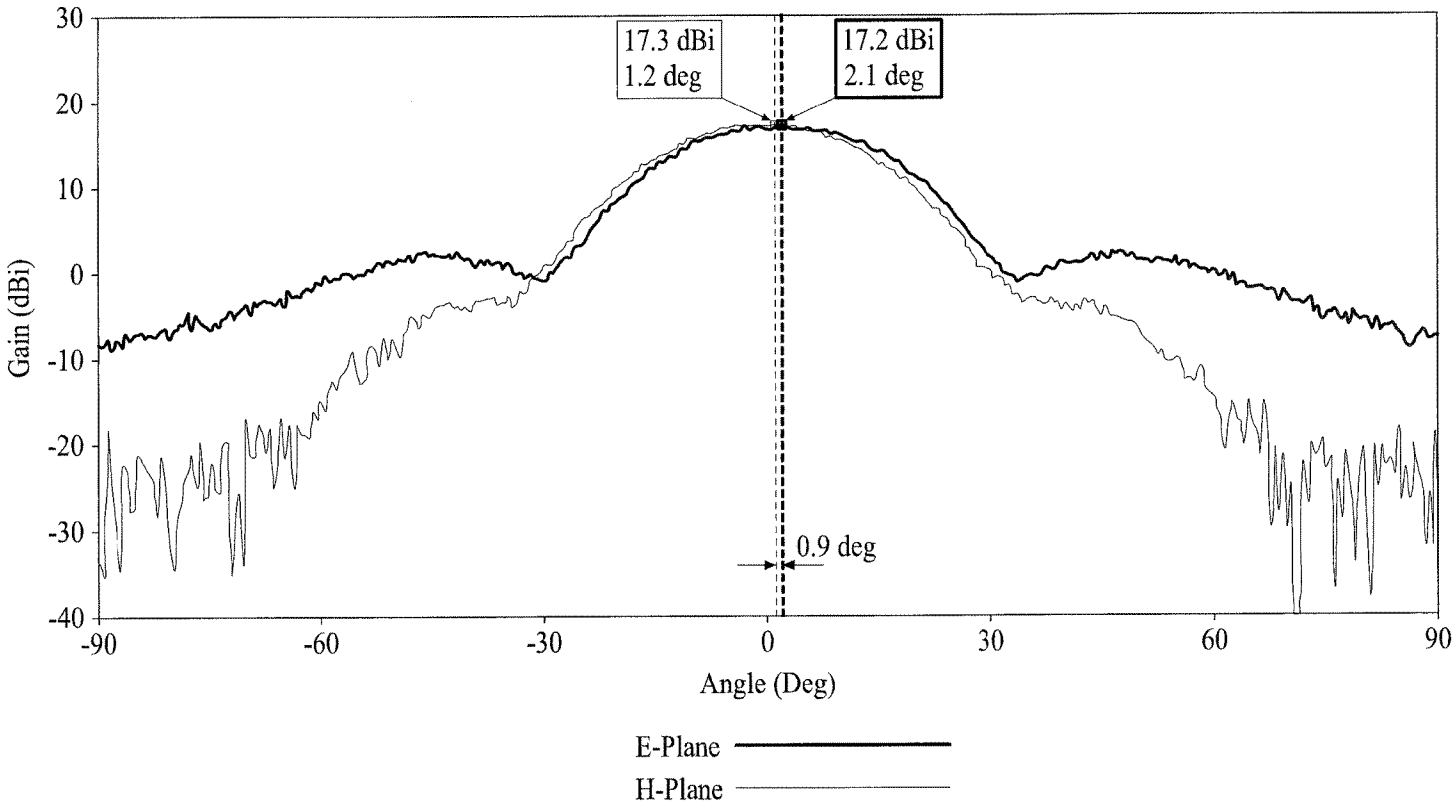
Figure 7:
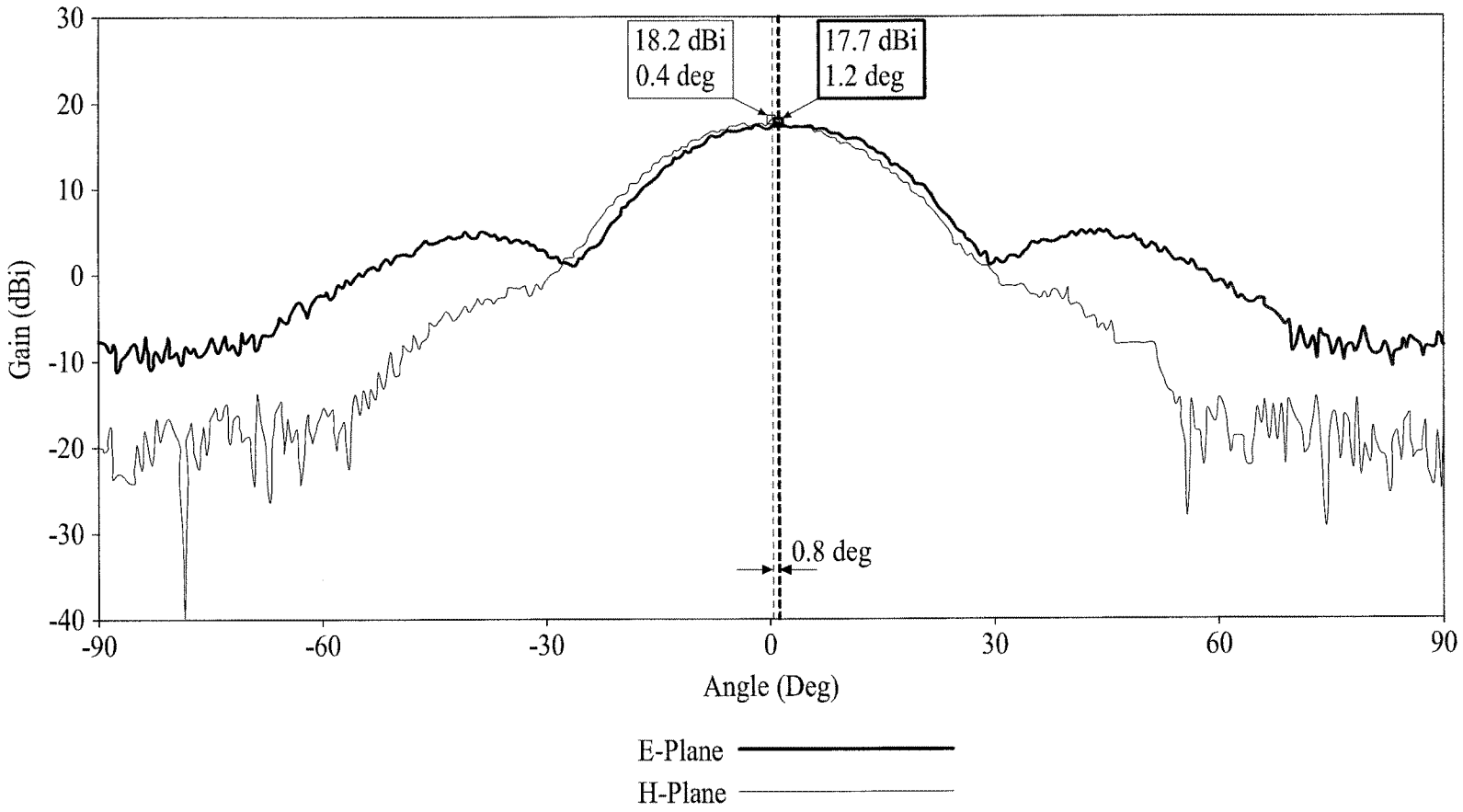

FIG. 3 is a disassembled view of the waveguide apparatus 10 of FIG. 1 in accordance with some embodiments of the present disclosure, wherein the second waveguide member 30 is rotated with respect to the Z-axis in FIG. 2 by 180 degrees. In some embodiments, the second waveguide member 30 is substantially the same as the first waveguide member 20. Consequently, the second waveguide member 30 can be manufactured by substantially the same fabrication process as the first waveguide member 20. In some embodiments, the first waveguide member 20 and the second waveguide member 30 are made of metal such as aluminum, and manufactured by CNC (computer numerical control) machining.

In some embodiments, the first waveguide member 20 includes at least one first hole 20A and at least one second hole 20B, the at least one first hole 20A penetrates the first wall 21 along a first direction (the X-direction as shown in FIG. 1), and the at least one second hole 20B penetrates the second wall 23 along the first direction. Similarly, the second waveguide member 30 includes at least one third hole 30A and at least one fourth hole 30B, the at least one third hole 30A penetrates the third wall 31 along the first direction, and at least one fourth hole 30B penetrates the fourth wall 33 along the first direction.

In some embodiments, the first waveguide member 20 does not include an opening penetrating the first wall 21 along a second direction (the Y-direction as shown in FIG. 1) substantially perpendicular to the first direction (the X-direction as shown in FIG. 1); in addition, the first waveguide member 20 does not include an opening penetrating the second wall 23 along the second direction. Similarly, the second waveguide member 30 does not include an opening penetrating the third wall 31 along the second direction substantially perpendicular to the first direction; in addition, the second waveguide member 30 does not include an opening penetrating the fourth wall 33 along the second direction.

In some embodiments, after the first waveguide member 20 is attached to the second waveguide member 30, the at least one first hole 20A of the first waveguide member 20 communicates with the at least one fourth hole 30B of the second waveguide member 30, and the at least one second hole 20B of the second waveguide member 30 communicates with the at least one third hole 30A of the first waveguide member 20. In some embodiments, the at least one second hole 20B of the first waveguide member 20 is a screw hole having threads, the at least one fourth hole 30B of the second waveguide member 30 is a screw hole having threads, and the fasteners 17 are screws configured to engage with the screw holes.

In some embodiments, after the first waveguide member 20 is attached to the second waveguide member 30, the fourth wall 33 covers the at least one first hole 20A, and the second wall 23 covers the at least one third hole 30A. Consequently, the interior of the waveguide 13 is not exposed to the first hole 20A or the third hole 30A. In addition, after the first waveguide member 20 is attached to the second waveguide member 30, the four inner surfaces of the four walls of the waveguide apparatus 10 are substantially not formed with a step structure. In other words, the waveguide 13 defined by the four walls of the waveguide apparatus 10 is substantially planar for propagating wireless signals.

In some embodiments, the second wall 23 has a slanted side 23A with respect to a third direction (the Z-axis as shown in FIG. 1), the third wall 31 has a slanted inner surface 31A with respect to the third direction, and the slanted side 23A is attached to the slanted inner surface 31A; similarly, the fourth wall 33 has a slanted side 33A with respect to the third direction, the first wall 21 has a slanted inner surface 21A with respect to the third direction, and the slanted side 33A is attached to the slanted inner surface 21A.

In some embodiments, in the second wall 23, the upper end width is larger than the bottom end width measured along the first direction (X-direction), and the at least one second hole 20B is not formed in the upper portion but is instead formed in the lower portion with a larger width of the second wall 23; similarly, in the fourth wall 33, the upper end width is larger than the bottom end width measured along the first direction, and the at least one fourth hole 30B is not formed in the upper portion but is instead formed in the lower portion with a larger width of the fourth wall 33.

In some embodiments, in the first wall 21, the upper end width is larger than the bottom end width measured along the second direction (Y-axis), and the at least one first hole 20A is not formed in the upper portion but is instead formed in the lower portion with a larger width of the first wall 21; similarly, in the third wall 23, the upper end width measured along the second direction is larger than the bottom end width, and the at least one third hole 20B is not formed in the upper portion but is instead fainted in the lower portion with a larger width of the third wall 23.

In some embodiments, an upper end width measured along the first direction (X-direction) of the first wall 21 is substantially the same as an upper end width measured along the second direction (Y-direction) of the second wall 23. In some embodiments, the upper end width is larger than the bottom end width of the first wall 21, and the first wall 21 has a tapering upper end; the upper end width is larger than the bottom end width of the second wall 23, and the second wall 23 has a tapering upper end. In some embodiments, as shown in FIG. 2, the first wall 21 has a first outer surface 211, the second wall 23 has a second outer surface 231, the first outer surface 211 is substantially planar, and the second outer surface 231 is non-planar. In some embodiments, the second wall 23 has a wavy outer surface near an upper end.

Similarly, an upper end width measured along the first direction (X-direction) of the third wall 31 is substantially the same as an upper end width measured along the second direction (Y-direction) of the fourth wall 33. In some embodiments, the upper end width is larger than the bottom end width of the third wall 31, and the third wall 31 has a tapering upper end; the upper end width is larger than the bottom end width of the fourth wall 33, and the fourth wall 33 has a tapering upper end. In some embodiments, as shown in FIG. 2, the third wall 31 has a third outer surface 311, the fourth wall 33 has a fourth outer surface 331, the third outer surface 311 is substantially planar, and the fourth outer surface 331 is non-planar. In some embodiments, the fourth wall 33 has a wavy outer surface near an upper end.

In some embodiments, the first waveguide member 20 has a guiding pin 25A configured to engage with a guiding hole 35B of the second waveguide member 30. In some embodiments, the second waveguide member 30 has a guiding pin 35A configured to engage with a guiding hole 25B of the second waveguide member 20. In some embodiments, the first waveguide member 20 has a fixed portion 27 with fixing holes 27A, the second waveguide member 30 has a fixed portion 37 with fixing hole 37A, and the waveguide apparatus 10 can be fixed onto an external apparatus by fasteners (not shown in the drawings) penetrating the fixing hole 27A and the fixing hole 37A.

FIGS. 4 to 8 are gain (in dB) diagrams of the direction difference between the E-plane and the H-plane of the waveguide apparatus 10 with respect to angles (in degrees or Deg) in accordance with some embodiments of the present disclosure. FIG. 9 is a measured frequency response diagram of the waveguide apparatus 10 with respect to frequencies (in GHz) vs. return loss (S(1,1) in dB) in accordance with some embodiments of the present disclosure. FIG. 10 is a table showing the detailed properties of the waveguide apparatus 10 in accordance with some embodiments of the present disclosure.

Figure 8:
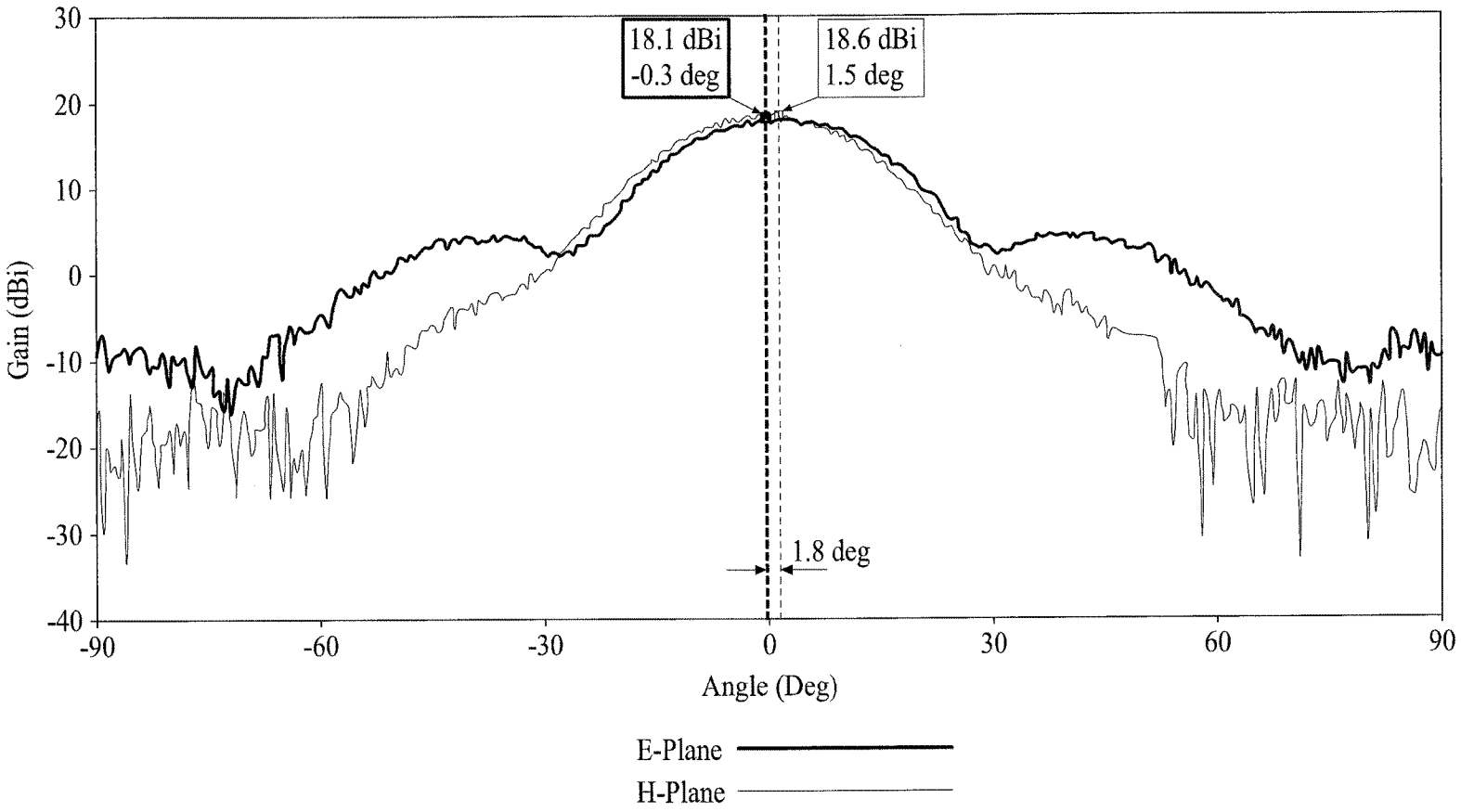
Figure 9:
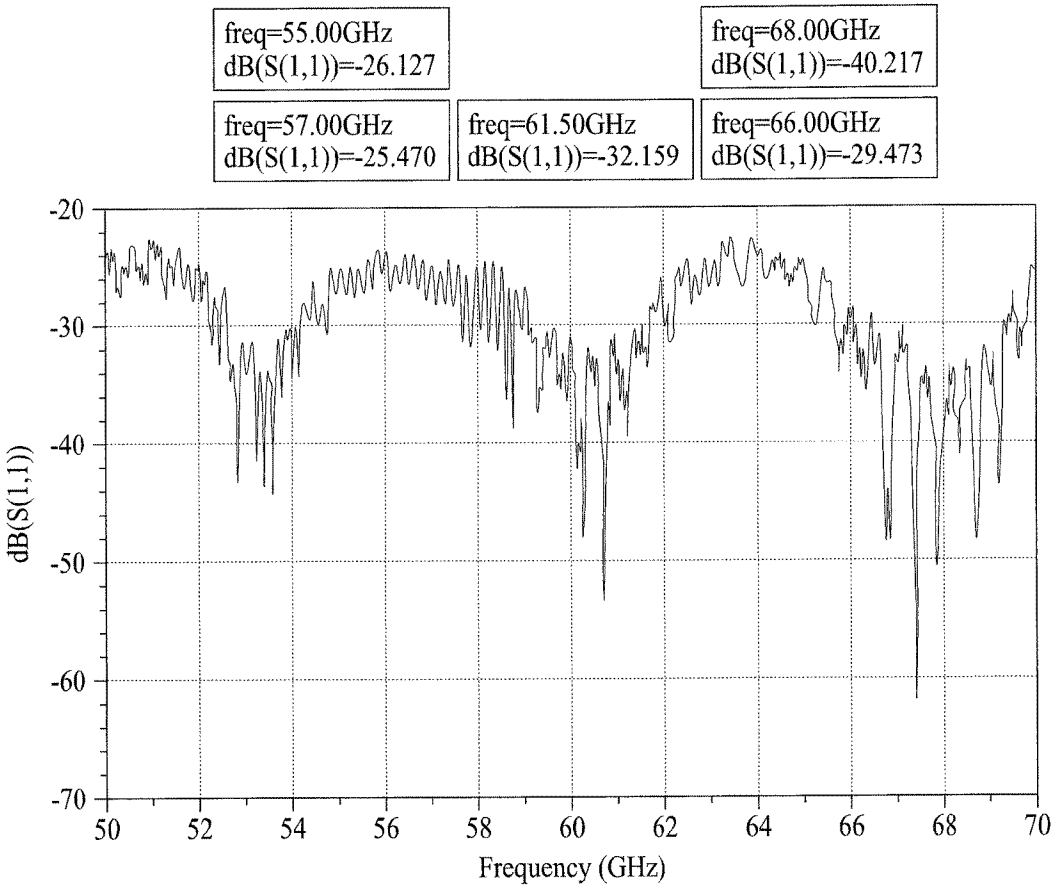
FIG. 9 is a measured frequency response gain (in dB) diagram of the waveguide apparatus with respect to frequencies in accordance with some embodiments of the present disclosure.

As can be seen from FIGS. 4 to 8 and the table in FIG. 10, the direction difference between the E-plane and the H-plane of the waveguide apparatus 10 is less than 2 degrees for the relevant frequencies. The peak gain means the highest gain in dB of the main beam, and the peak gain direction means the angle in degrees (Deg) of the peak of the main beam as shown by the respective values in the FIG. 10 Table and the values in the respective boxes in FIGS. 4-8. In addition, as shown in the response diagram in FIG. 9, the return loss of the waveguide apparatus 10 is 26.127 dB at 55.00 GHz (FIG. 4), 25.470 dB at 57.00 GHz (FIG. 5), 32.159 dB at 61.50 GHz (FIG. 6), 29.473 dB at 66.00 GHz (FIG. 7), and 40.217 dB at 68.00 GHz (FIG. 8). In other words, the return losses of the waveguide apparatus 10 at the frequencies listed above are all larger than 20 dB.

Figure 11:
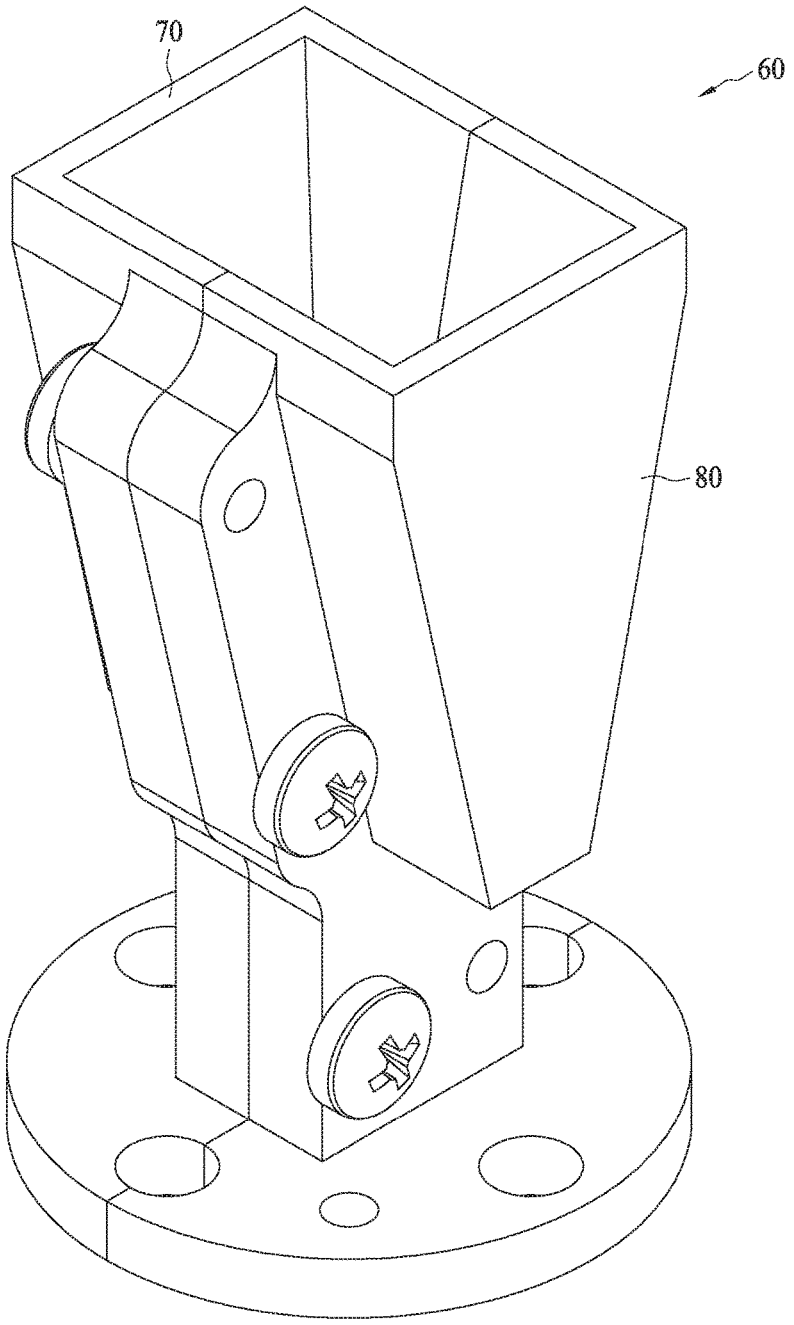
FIG. 11 is an assembled view of a waveguide apparatus in accordance with a comparative embodiment of the present disclosure.
Figure 12:
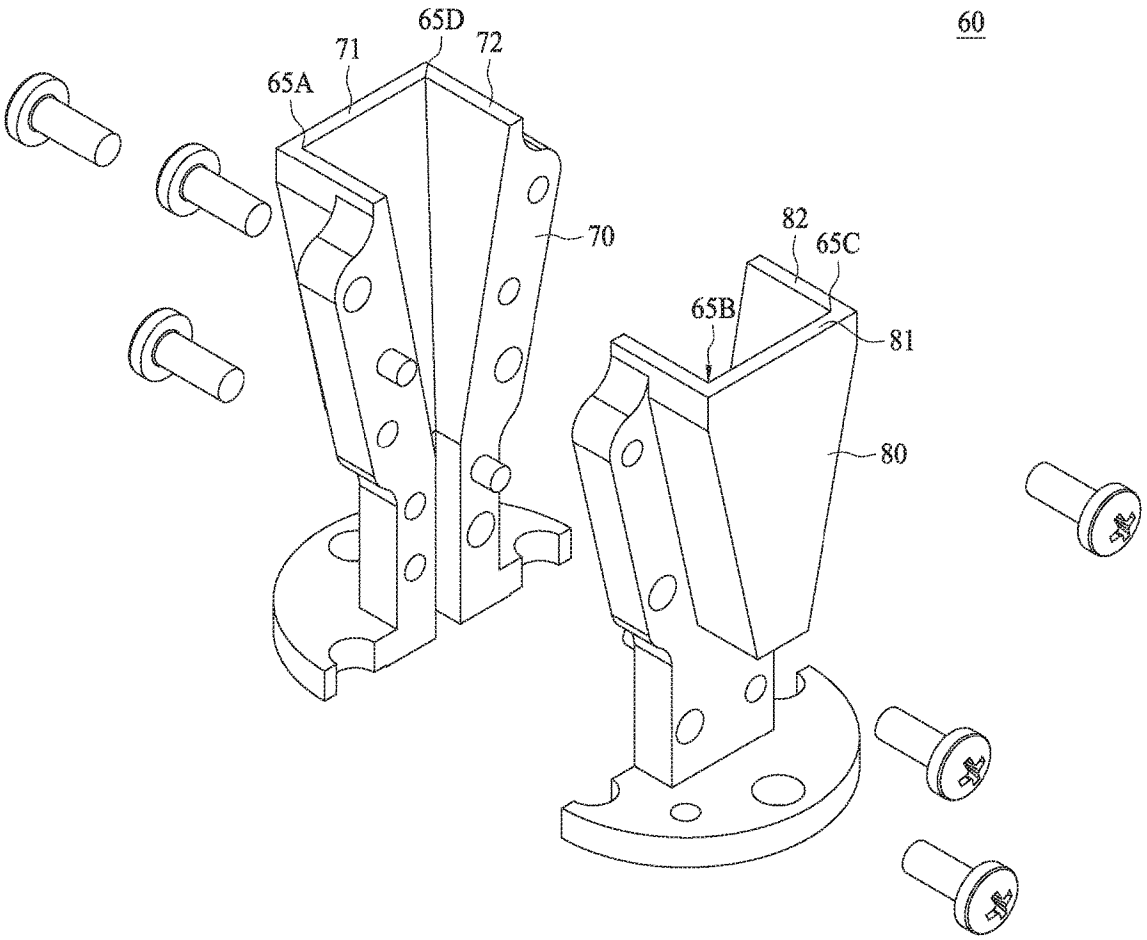
FIG. 12 is a disassembled view of the waveguide apparatus in accordance with some embodiments of the present disclosure.

FIG. 11 is an assembled view of a waveguide apparatus 60 in accordance with a comparative embodiment of the present disclosure. FIG. 12 is a disassembled view of the waveguide apparatus 60 in accordance with some embodiments of the present disclosure. Compared to the waveguide apparatus 10 of FIG. 1 which is diagonally divided into two substantially identical parts (the first waveguide member 20 and the second waveguide member 30) shown in FIG. 2, the waveguide apparatus 60 shown in FIG. 12 is centrally divided into two substantially identical parts (a waveguide member 70 and a waveguide member 80).

In the waveguide apparatus 60 shown in FIG. 12, the waveguide member 70 includes one wall 71 and two half walls 72, the waveguide member 80 includes one wall 81 and two half walls 82, and two of the four walls of the waveguide apparatus 60 are formed by the combination of the waveguide member 70 and the waveguide member 80. In contrast, in the waveguide apparatus 10 shown in FIGS. 1 and 2, each part includes two of the four walls.

In the waveguide apparatus 60 shown in FIG. 12, the waveguide member 70 includes two corners 65A and 65D, and the waveguide member 80 includes two corners 65B and 65C. In contrast, in the waveguide apparatus 10 shown in FIGS. 1 and 2, each waveguide member includes one of the four corners, and two of the four corners of the waveguide apparatus 10 are formed by the combination of the two waveguide members.

In the waveguide apparatus 10 shown in FIGS. 1-2, each waveguide member includes two complete inner planes of the waveguide, and the combination of the two waveguide members forms the four inner planes of the waveguide. In the waveguide apparatus 60 shown in FIGS. 11 and 12, each waveguide member includes one complete inner plane and two half inner planes of the waveguide, and the combination of the two parts forms two complete inner planes from the four half inner planes (two half inner planes from each part). The combination of the two waveguide members to form the waveguide apparatus 60 may result in two inner planes having a step structure at the interface of the two assembled waveguide members due to a misalignment of the two waveguide members, and the step structure may result in a serious degradation of the electronic properties of the waveguide.

Figure 13:
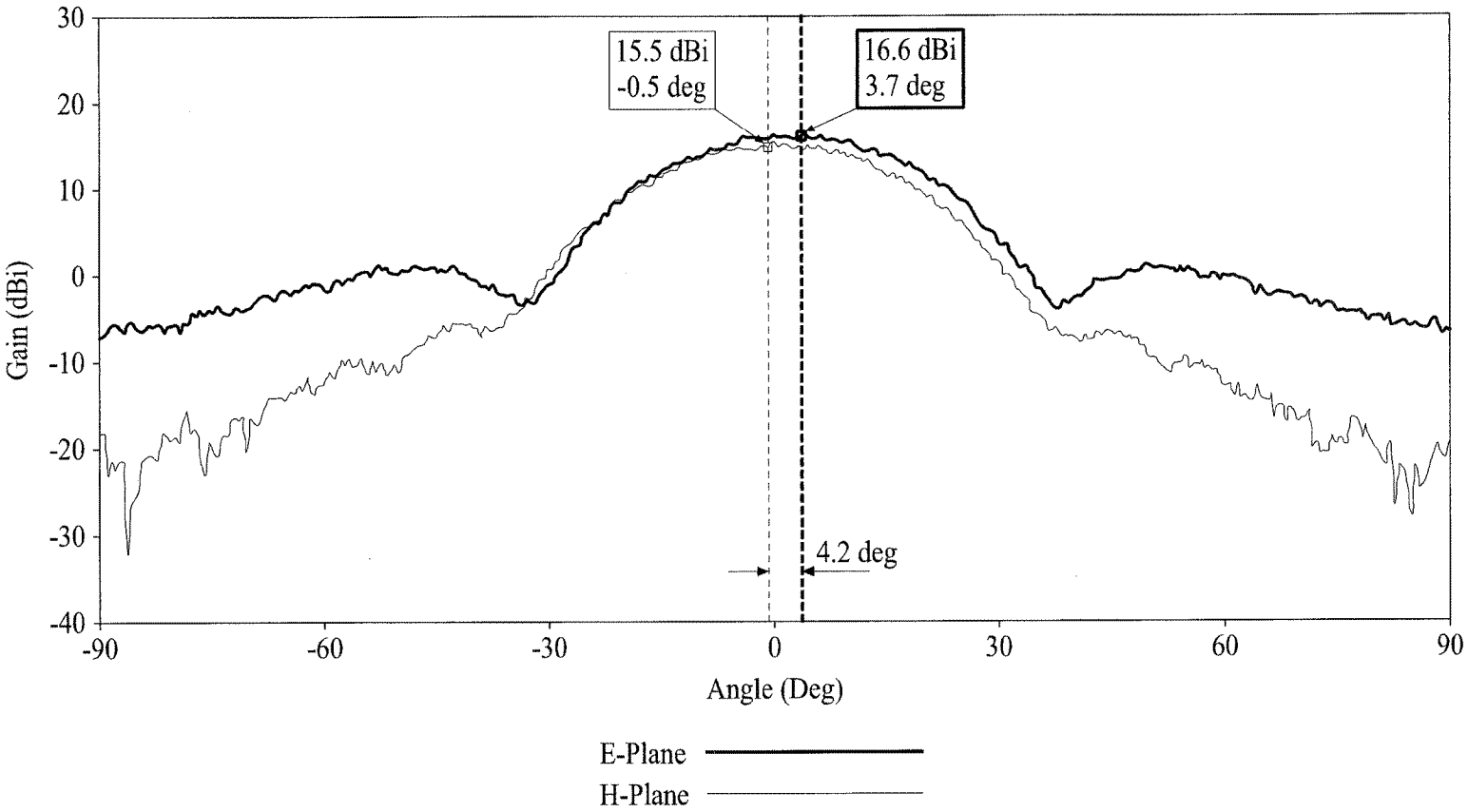
FIG. 13 is a gain (in dB) diagram of the direction difference between the E-plane and the H-plane of the waveguide apparatus at the measurement point (55.00 GHz) in accordance with the comparative embodiment of the present disclosure.

FIG. 13 is a gain (in dB) diagram of the direction difference between the E-plane and the H-plane of the waveguide apparatus 60 at 55.00 GHz in accordance with the comparative embodiment of the present disclosure. FIG. 14 is a table showing the detailed properties of the waveguide apparatus 10 of FIGS. 1 and 2 and the waveguide apparatus 60 of FIGS. 11 and 12 in accordance with the present disclosure. As can be seen from FIG. 4 and the table in FIG. 14, the direction difference between the E-plane and the H-plane of the waveguide apparatus 10 at 55.00 GHz is 0.8 degree; in contrast, referring to FIG. 13 and the table in FIG. 14, the direction difference between the E-plane and the H-plane of the waveguide apparatus 60 at 55.00 GHz is 4.2 degrees. Obviously, the waveguide apparatus 60 suffers from a very serious degradation of the electronic property (the direction difference between the E-plane and the H-plane), due to the stepped structure of the inner plane caused by misalignment of the two parts forming the waveguide apparatus 60.

The embodiments of the present disclosure provide a waveguide apparatus of two substantially identical waveguide members for receiving wireless signals. Consequently, the two waveguide members can be manufactured by substantially the same fabrication process. In addition, the waveguide apparatus is diagonally divided into two substantially identical waveguide members, and the two waveguide members can be assembled to form the waveguide apparatus substantially without a step structure in the inner plane of the waveguide.

In some embodiments, a waveguide member includes a first wall and a second wall forming a corner, wherein the waveguide member includes at least one first hole penetrating the first wall along a first direction and at least one second hole penetrating the second wall along the first direction.

In some embodiments, a waveguide apparatus includes a first waveguide member and a second waveguide member attached to the first waveguide member to form a waveguide having an aperture for receiving wireless signals; wherein the first waveguide member includes a first wall and a second wall forming a first corner of the aperture, the second waveguide member includes a third wall and a fourth wall forming a third corner of the aperture, the second wall and the third wall form a second corner of the aperture, and the fourth wall and the first wall form a fourth corner of the aperture.

Although the present disclosure and its advantages have been described in detail, it should be understood that various changes, substitutions and alterations can be made herein without departing from the spirit and scope of the disclosure as defined by the appended claims. For example, many of the processes discussed above can be implemented in different methodologies and replaced by other processes, or a combination thereof.

Moreover, the scope of the present application is not intended to be limited to the particular embodiments of the process, machine, manufacture, composition of matter, means, methods and steps described in the specification. As one of ordinary skill in the art will readily appreciate from the disclosure of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A waveguide member, comprising a first wall and a second wall forming a corner, wherein the waveguide member includes at least one first hole penetrating the first wall along a first direction and at least one second hole penetrating the second wall along the first direction;

wherein the first wall has a first outer surface, the second wall has a second outer surface, the first outer surface is planar, and the second outer surface is non-planar.

2. A waveguide apparatus, comprising:

a first waveguide member; and a second waveguide member attached to the first waveguide member to form a waveguide having an aperture for receiving wireless signals;

wherein the first waveguide member includes a first wall and a second wall forming a first corner of the aperture, the second waveguide member includes a third wall and a fourth wall forming a third corner of the aperture, the second wall of the first waveguide member and the third wall of the second waveguide member form a second corner of the aperture, and the fourth wall of the second waveguide member and the first wall of the first waveguide member form a fourth corner of the aperture;

wherein the first wall has a first outer surface, the second wall has a second outer surface, the first outer surface is planar, and the second outer surface is non-planar.

3. The waveguide apparatus of claim 2, wherein the second waveguide member is the same as the first waveguide member.

4. The waveguide apparatus of claim 2, wherein the first waveguide member includes:

at least one first hole penetrating through the first wall along a first direction; and at least one second hole penetrating through the second wall along the first direction.

5. The waveguide apparatus of claim 4, wherein the second waveguide member includes:

at least one third hole penetrating the third wall along the first direction; and at least one fourth hole penetrating the fourth wall along the first direction.

6. The waveguide apparatus of claim 5, wherein the at least one first hole communicates with the at least one fourth hole, and the at least one second hole communicates with the at least one third hole.

7. The waveguide apparatus of claim 5, wherein the fourth wall covers the at least one first hole, and the second wall covers the at least one third hole.

* * * * *